US006485397B1

(12) United States Patent
Manderbacka

(10) Patent No.: US 6,485,397 B1
(45) Date of Patent: Nov. 26, 2002

(54) BRAKE ARRANGEMENT FOR MAGNETIC OR ELECTRIC ERGOMETER

(76) Inventor: Mats Manderbacka, Perkas, FIN-67100 Karleby (FI)

( * ) Notice: Subject to any disclaimer, the term of this patent is extended or adjusted under 35 U.S.C. 154(b) by 0 days.

(21) Appl. No.: 09/535,095

(22) Filed: Mar. 24, 2000

(30) Foreign Application Priority Data

Mar. 30, 1999 (FI) ..... 990707

(51) Int. Cl.[7] ..... A63B 69/16
(52) U.S. Cl. ..... 482/63; 482/57
(58) Field of Search ..... 482/51–56, 57, 482/60–62, 63, 64, 65, 70–72, 110, 114, 903, 8; 601/26, 31–36; 188/24.11–24.22, 25–27

(56) References Cited

U.S. PATENT DOCUMENTS

| | | | | | |
|---|---|---|---|---|---|
| 3,572,700 | A | * | 3/1971 | Mastropaolo | 272/79 |
| 3,833,216 | A | * | 9/1974 | Philbin | 272/73 |
| 5,018,724 | A | * | 5/1991 | Naser et al. | 272/73 |
| 5,031,901 | A | | 7/1991 | Saarinen | |

FOREIGN PATENT DOCUMENTS

DE 0215 177 A1 * 9/1985 ..... A63B/69/16

* cited by examiner

*Primary Examiner*—Jerome W. Donnelly
*Assistant Examiner*—Tam Nguyen
(74) *Attorney, Agent, or Firm*—McDonnell Boehnen Hulbert & Berghoff

(57) ABSTRACT

The present invention relates to a brake arrangement (4) for a magnetic or an electric ergometer, e.g. an ergometer bike. The object of the invention is to provide an ergometer which is as user friendly as magnetic and electric ergometers, while the calibration of the ergometer is simplified considerably. The ergometer comprises a frame, a power transmission system (2) and a rotating member (3) which is driven by the power transmission system and is at least partially made of or coated with a conductive material or magnetic material a brake arrangement (4) is provided to adjust the rotation resistance of the rotating member, the arrangement consisting, according to the invention, of at least one magnetic brake member (8) which is at an adjustable distance from the rotating member. The brake member (8) has a fixed mass and is movable in a direction substantially parallel with, the cross-sectional plane of the rotating member (3) and parallel with the radius of the rotating member. The brake member can also be moved in a direction parallel with the outer circumference of the rotating member.

5 Claims, 2 Drawing Sheets

PRIOR ART

BRAKE ARRANGEMENT FOR MAGNETIC OR ELECTRIC ERGOMETER

FIELD OF THE INVENTION

The present invention relates to a brake arrangement for a magnetic or an electric ergometer according to the preamble of claim 1. Such an ergometer can be made e.g. of an ergometer bike.

BACKGROUND OF THE INVENTION

Different ergometers and particularly ergometer bikes have for years been the best way of measuring a person's condition and oxygen uptake. These arrangements usually comprise a frame, two pedals, a power transmission system, a rotating member and a brake arrangement. The brake arrangement included the ergometer bike preferably comprises a mechanical friction system or a magnetic or an electric eddy-current brake.

Prior art brake arrangements are provided to affect the rotating member, e.g. a flywheel, which is driven by the power transmission system. The rotation of the flywheel is slowed down e.g. mechanically by a brake band placed against the outer circumference of the flywheel. The friction force between the flywheel and the brake band can be varied by tightening or loosening the brake band in respect of the outer circumference of the flywheel. In that case the braking force and the force needed to drive the power transmission system vary.

An eddy-current brake similarly comprises a rotating member which is at least partially made of or coated with a conductive material or magnetic means. Other magnetic members are mounted e.g. in the frame, their distance from the rotating member being adjustable. The magnetic members mounted in the frame generate, together with the rotating member, eddy-currents which slow down the speed of the rotating member. By increasing or decreasing the distance between the magnetic members mounted in the frame and the rotating member, the braking force and the force needed to drive the power transmission system can be varied.

An ergometer bike used for testing persons must be, in addition to the brake arrangement, provided with a measuring device which facilitates reading of the braking force and the load. The arrangement also needs to be accurate, reliable and easy to calibrate. This is the only way of obtaining reliable and comparable test results.

In an ergometer bike which comprises a friction-type brake arrangement the resistance of the brake band can be adjusted e.g. by providing it with a pendulum-type counterweight. The counterweight is usually arranged so that an increase in the tension of the brake band in respect of the flywheel's outer circumference can be directly read from the pendulum motion of the counterweight. Usually an increase in the load rises the pendulum from its rest position. This solution is utilized e.g. in ergometer bikes produced by Monark.

A disadvantage of the solution described above is that it is difficult to adjust the friction resistance of the flywheel accurately. Furthermore, the friction coefficient between the flywheel and the braking band may change during the test either because of the increased temperature of the braking band or because of the speed of the flywheel. This means that a brake arrangement provided with a friction brake and a counterweight must be adjusted continuously during a test.

Such continuous adjustment naturally has a considerable effect on the test result.

A further disadvantage of a brake arrangement based on friction is related to the user friendliness of the ergometer bike. Brake arrangement of this kind is relatively loud, which is irritating both to the person who is to be tested and for the personnel carrying out the test. In addition, the function of an ergometer bike provided with a brake arrangement based on friction is uneven and abrupt.

In normal exercise bikes magnetic and electric brake systems replaced the brake arrangement based on friction for a long time ago. The friction-type bikes described above are, however, still used as test apparatuses because they are relatively easy to calibrate and because the load can be read with sufficient accuracy from the position of the counterweight.

Compared to the arrangement with a braking band, the brake arrangement of the eddy-current type functions very smoothly and silently. A disadvantage of this arrangement is, however, that it is difficult to calibrate the load of power transmission accurately enough. The characteristics of electric and magnetic resistance which is used in the arrangement may also change in the course of time. Since brake arrangements of this type are usually built in the frame of the ergometer bicycle, the arrangement can be calibrated only with special tools designed for this particular purpose.

Because of the problems and costs related to calibration, it is usually performed only once a year. If a calibration error is found during the calibration process, it is impossible to know when the error occurred. In the worst case all the test results obtained since the previous calibration are completely useless.

In scientific research it is usually necessary to control the calibration of the equipment every day, for which reason the electric and magnetic brake systems have not become more common, but several tests and test series are still carried out using ergometer bikes provided with brake arrangements of the friction type regardless of their deficiencies in respect of the user friendliness.

BRIEF DESCRIPTION OF THE INVENTION

The present invention considerably reduces the problems related to the prior art solutions, user friendliness, accuracy of reading the load force and calibration of electric or magnetic brake arrangements in ergometers.

The object of the present invention is to enable controlling of the calibration of the ergometer even every day. The present invention provides an ergometer which has the user friendliness of electric and magnetic brake arrangements and the calibration of the brake arrangement is as simple as the calibration of a brake arrangement based on friction.

The solution to the above-mentioned problems has been achieved by the present invention which has the characteristics disclosed in the claims. An arrangement of the present invention is characterized by what is disclosed in the characterising part of claim 1.

The preferred embodiments of the invention are disclosed in the dependent claims.

In connection with the present invention an ergometer means a system for measuring and evaluating the condition of a person to be tested. An ergometer can be attached to a bicycle, a manually operated hand bike, a rowing machine or a stepper.

Compared to the prior art, this arrangement provides several considerable advantages. The load force of the ergometer can be read much more accurately with an arrangement according to the invention. In an ergometer provided with an electric brake arrangement the load force is often measured directly with a force sensor which requires an amplifier enabling reading. In the brake arrangement according to the invention a high deviation can be obtained with the pendulum of the arrangement even with slight changes in the amount of force.

When a force sensor is used for measuring the load force, the measuring signal is given in millivolts. Thus the threshold for interference is very low. For example, the use of a mobile phone near the force sensor can cause interference sufficient for influencing the measuring result, which leads to an unnecessary repetition of the test carried out. In a brake arrangement comprising a pendulum system the changes in the angle of the pendulum can be measured e.g. with an ordinary potientiometer, in which case the measuring signal is always given in volts, which makes the system in practice immune to external interference.

A brake arrangement according to the present invention is also very inexpensive to produce because the deviation of the pendulum can be measured directly with a simple mechanical measuring device, a simple potientiometer or with an accelerometer which are considerably cheaper than a force sensor which is needed in the other electric brake arrangements.

The calibration of an ergometer according to the present invention can be controlled in a simple manner virtually without any costs when desired, even several times a day. The calibration of the ergometer does not require any special calibration equipment. It is sufficient to provide the pendulum of the brake arrangement with a weight of a known size so that the deviation of the pendulum can be observed.

The ergometer of the present invention also improves the user friendliness of the device considerably when used in various tests. The ergometer, when attached to a bicycle, is also silent and very comfortable to pedal thanks to its smooth going.

BRIEF DESCRIPTION OF THE DRAWINGS

In the following the invention will be described in greater detail with reference to the drawings, in which.

DETAILED DESCRIPTION OF THE INVENTION

Figure 1:
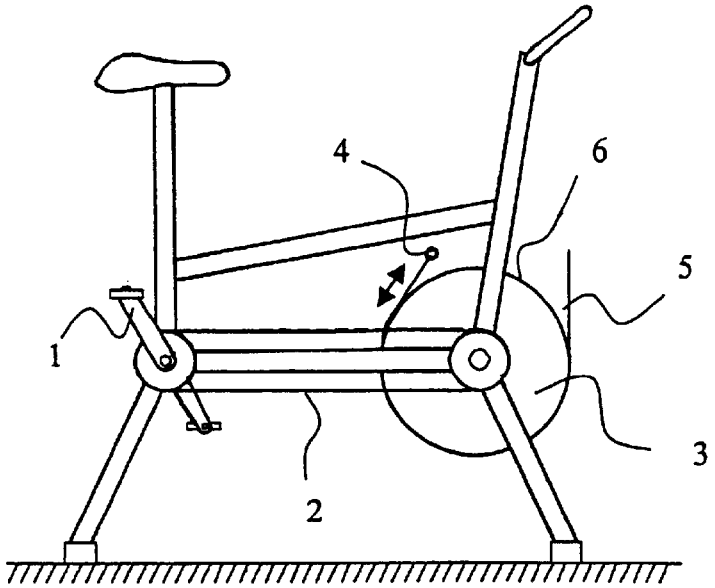
FIG. 1 illustrates schematically the most important parts of a prior art ergometer bike, FIG. 2 schematically illustrates the most important parts of a brake and calibration arrangement according to the present invention.

An ergometer according to the present invention is described using an ergometer bike as an example. FIG. 1 schematically illustrates the essential parts of an ergometer bike known per se. The arrangement comprises a frame which is provided with two pedals 1. A rotating member 3, such as a flywheel, is made to rotate in respect of the frame by means of a power transmission system 2. The flywheel is provided with a brake arrangement 4 for influencing the flywheel. The rotation of the flywheel is slowed down mechanically with a brake band 5 arranged against the outer circumference 6 of the flywheel.

Figure 2:
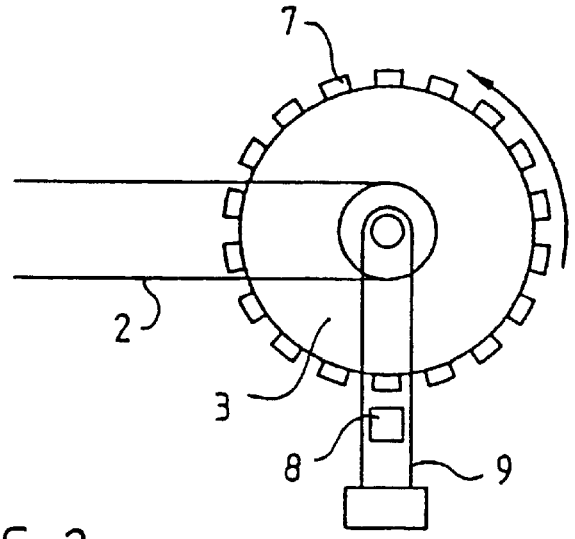
Figure 3:
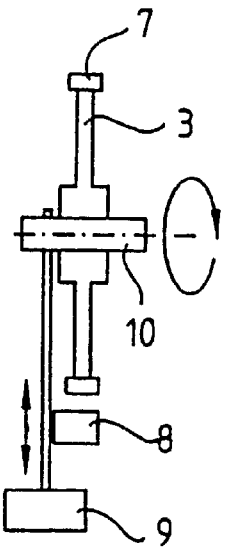
FIG. 3 is a cross-sectional view of a brake and calibration arrangement according to FIG. 2.
Figure 4:
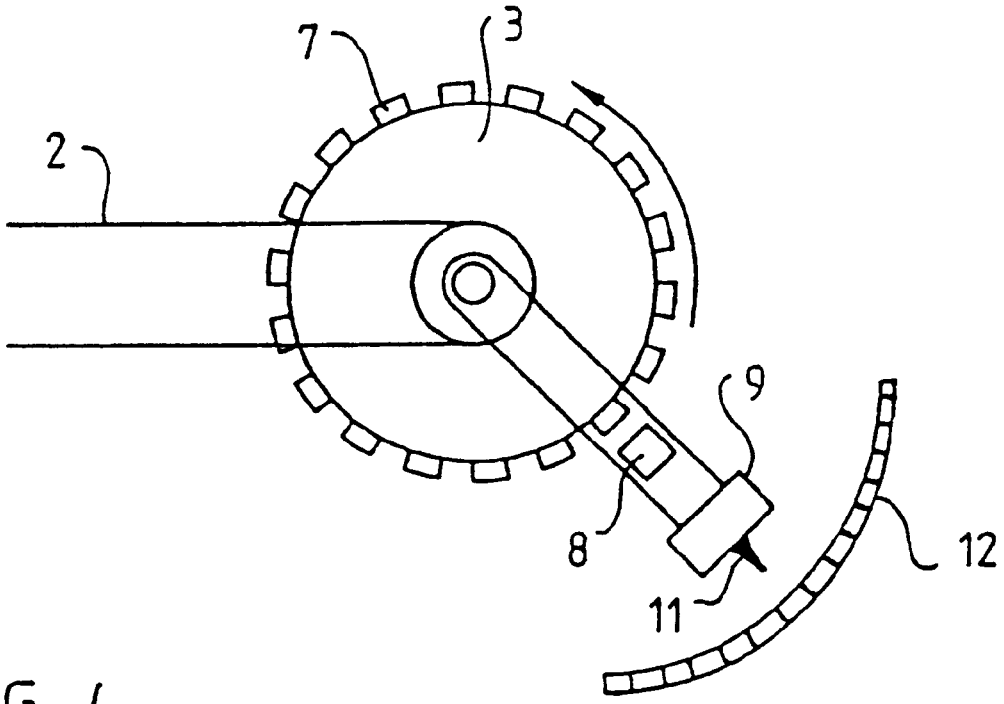
FIG. 4 shows a brake and calibration arrangement according to FIG. 1 in operation and provided with a measuring instrument.

The present ergometer, in comparison, comprises a brake arrangement, preferably provided with a magnetic or an electric eddy-current brake according to FIGS. 2 to 4. The eddy-current brake comprises a rotating member, i.e. a flywheel 3, which is at least partially made of or coated with a conductive material or magnetic means 7. The flywheel may also be coated with aluminum or copper or provided with permanent magnets similar to those used in magnetic ergometers. To affect the motions of the rotating member, at least a magnetic brake member 8 is positioned at an adjustable distance from the rotating member. By increasing or decreasing the distance between the magnetic brake member and the rotating member)the braking force and the force needed to drive the power transmission system can be varied.

The magnetic brake member 8 has a known weight and is, according to the preferred embodiments of the present invention shown in FIGS. 2 to 4, attached to a pendulum 9 which also has a known weight. Such a pendulum can rotate freely in a vertical plane substantially parallel with the cross-sectional plane of the rotating member, i.e. the flywheel 3. The brake member 8 can thus be moved along the pendulum in a direction which substantially overlaps with the radius of the flywheel so that the brake member moves either closer to or further away from the flywheel along a shaft which substantially extends through a central shaft 10 onto which the rotating member is mounted. In the example the pendulum is concentrically pivoted on the flywheel so that the axis of rotation of the pendulum preferably coincides with the central shaft of the flywheel.

When the magnetic brake member 8 is moved closer to the flywheel 3, the load force of the ergometer increases, i.e. the braking force which influences the flywheel, and when the brake member is moved further away from the flywheel, the load force of the ergometer decreases. Since the brake member is attached to the pendulum 9 instead of the frame of the ergometer, the total amount of force that influences the flywheel will also influence the whole brake arrangements, i.e. the pendulum and the brake member 8 attached thereto. Consequently, when the flywheel is set in motion, the pendulum moves from its original position in the direction of rotation of the flywheel as shown in FIG. 4.

When the flywheel is rotating, the position of the pendulum in relation to its rest position is always directly proportional to the braking force of the flywheel and the brake member 8. By providing the pendulum with a pointer 11 and the ergometer frame with a load scale 12 the load force of the brake arrangement can be read. The position of the pendulum in relation to its rest position can be read even with a pulse measuring device, a potientiometer or an accelerometer, for example. This means that the arrangement for slowing down the flywheel according to the present invention is very accurate and at the same time the calibration of the magnetic or electric ergometer is easy and can be controlled at any time.

The calibration of the brake arrangement according to the present invention does not require any special measuring devices. It is sufficient to provide the pendulum with a calibration weight which has a known weight and check that the changed deviation of the pendulum corresponds to the value calculated for the pendulum using its new total weight. If the deviation needs to be corrected, one needs to adjust only the position of the brake member 8 on the pendulum with a few simple operations.

The specification and the attached figures are only intended to describe the present invention. Thus the invention is not limited to the embodiment described above or to the embodiments disclosed in the appended claims, but the invention may vary within the scope of the inventive concept described in the appended claims.

What is claimed is:

1. An ergometer comprising:

a frame, a power transmission system, a rotating member driven by the power transmission system and arranged around a central shaft of the frame, and a brake arrangement having a longitudinal shaft with one end pivotally attached to said central shaft and a magnetic- brake member that is arranged on said longitudinal shaft at an adjustable distance from the rotating member, wherein the rotating member is at least partially made of or coated with a conductive material or magnetic means and the brake member has a fixed mass and is movable radially toward and away from the outer circumference of the rotating member in the cross-sectional plane of the rotating member or parallel therewith as well as concentrically around the central shaft along the outer circumference of the rotating member.

2. A brake arrangement according to claim 1, wherein the brake arrangement further comprises a pointer which cooperates with a load scale attached to the frame, the pointer and the load scale being arranged to provide together a measurement of the braking effect of the rotating member.

3. A brake arrangement according to claim 2, wherein the rotating member and the brake arrangement are arranged concentrically around the central shaft.

4. A brake arrangement according to wherein the longitudinal shaft comprises a pendulum which has a predetermined mass, the brake member being arranged to be moved along the pendulum.

5. A brake arrangement according to claim 4, wherein the pendulum is pivoted on the same shaft as the rotating member.

* * * * *